US007769308B2

(12) United States Patent
Kong et al.

(10) Patent No.: US 7,769,308 B2
(45) Date of Patent: Aug. 3, 2010

(54) IMAGE FORMING APPARATUS TO PERFORM COLOR SUBSTITUTION, AND METHOD FOR CONTROLLING THE SAME

(75) Inventors: Sook Hyun Kong, Hwaseong-si (KR); Eun Young Jung, Suwon-si (KR); Jae Ho Kim, Suwon-si (KR); Won Young Chi, Suwon-si (KR); Yoon Yi, Suwon-si (KR); Sung Hyun Ryu, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 132 days.

(21) Appl. No.: 11/943,117

(22) Filed: Nov. 20, 2007

(65) Prior Publication Data

US 2008/0124097 A1 May 29, 2008

(30) Foreign Application Priority Data

Nov. 28, 2006 (KR) ..... 10-2006-0118605

(51) Int. Cl.
*G03G 15/08* (2006.01)

(52) U.S. Cl. ..... 399/27

(58) Field of Classification Search ..... 399/27, 399/28, 53

See application file for complete search history.

(56) References Cited

U.S. PATENT DOCUMENTS 6,236,817 B1 * 5/2001 Kim ..... 399/53
2001/0003457 A1 * 6/2001 Doi ..... 347/5
2005/0219602 A1 * 10/2005 Mikami ..... 358/1.14
2006/0008114 A1 * 1/2006 Sekiguchi et al. ..... 382/100
2008/0181628 A1 * 7/2008 Ahn ..... 399/27

FOREIGN PATENT DOCUMENTS

JP 11227173 A * 8/1999
JP 2001071541 A * 3/2001
JP 2001-356052 12/2001
JP 2002-44472 2/2002
JP 2002044472 A * 2/2002
JP 2002-292836 10/2002
JP 2006301328 A * 11/2006

* cited by examiner

*Primary Examiner*—Quana M Grainger
(74) *Attorney, Agent, or Firm*—Stanzione & Kim, LLP

(57) ABSTRACT

An image forming apparatus and a method of controlling the image forming apparatus. When print data is printed, the remaining amount of toner of each of the CMYK colors is analyzed. When print data is printed, the apparatus analyzes an original color of the print data and analyzes respective remaining amounts of toner of a plurality of colors. If the remaining amount of toner of any of the plurality of colors is insufficient, the apparatus generates a plurality of corrected sample images having colors similar to the original color, the similar colors being obtained by combining colors of toner other than that of the insufficient remaining amount of toner, and prints a report including the generated plurality of corrected sample images. This allows the user to print their preferred colors even if the remaining amount of toner of any color is insufficient, thereby increasing convenience and economic efficiency.

9 Claims, 5 Drawing Sheets

- COLOR-CORRECTED SAMPLE REPORT -

THE REMAINING AMOUNT OF C TONER IS LESS THAN REFERENCE LEVEL SINCE C TONER WAS USED MUCH MORE THAN OTHER TONER.

YOU CAN OBTAIN THE FOLLOWING COLOR SAMPLES USING TONER OF THE OTHER COLORS WITHOUT USING THE C TONER.

SAMPLE 1

SAMPLE 2

SAMPLE 3

SAMPLE 4

SELECT ONE OF THE FOUR COLOR SAMPLES WHEN YOU WANT TO REDUCE THE CONSUMPTION OF C TONER.

FIG.4

COLOR-CORRECTED SAMPLE SELECTION MENU

1. SELECT NONE
2. SELECT COLOR OF SAMPLE 1
3. SELECT COLOR OF SAMPLE 2
4. SELECT COLOR OF SAMPLE 3
5. SELECT COLOR OF SAMPLE 4

IMAGE FORMING APPARATUS TO PERFORM COLOR SUBSTITUTION, AND METHOD FOR CONTROLLING THE SAME

CROSS-REFERENCE TO RELATED APPLICATIONS

This application claims the benefit of Korean Patent Application No. 2006-0118605, filed on Nov. 28, 2006 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to an image forming apparatus, which can print an image or material having a color similar to its original color when the remaining amount of toner of a specific color is insufficient, and a method of controlling the image forming apparatus.

2. Description of the Related Art

An image forming apparatus generally has functions to convert a document that a user has created through an application program or an image that a user has captured using a digital camera into encoded data and then to print the data on a sheet of paper in a format visible to the user. Examples of the image forming apparatus include a printer, a copier, and a facsimile.

A conventional image forming apparatus capable of printing color images includes respective toner of a plurality of colors such as cyan, magenta, yellow, and black (CMYK). The image forming apparatus produces and prints a color of print data by combining the plurality of toner colors.

The conventional image forming apparatus cannot perform normal quality printing if toner of one or more of the CMYK colors is insufficient.

SUMMARY OF THE INVENTION

The present general inventive concept provides an image forming apparatus, which can print an image or material having a color similar to its original color when the remaining amount of toner of a specific color is insufficient, and a method of controlling the image forming apparatus.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method to control an image forming apparatus including a plurality of toner having different colors, the method including analyzing an original color of print data; analyzing respective remaining amounts of the plurality of toner; generating a corrected color similar to the original color according to the remaining amounts of the plurality of toner; and outputting the corrected color if any of the remaining amounts of the plurality of toner is insufficient.

Generating the corrected color includes determining whether any of the remaining amounts of the plurality of toner is insufficient and generating, if any of the remaining amounts of the plurality of toner is insufficient, a plurality of corrected colors similar to the original color by combining colors of toner having the remaining amounts that are sufficient.

Determining whether any of the remaining amounts of the plurality of toner is insufficient includes determining whether each of the remaining amounts of the plurality of toner is less than or equal to a predetermined reference level.

The plurality of corrected colors is implemented as a plurality of specific colors to compensate for the color of the toner having the insufficient remaining amount by combining the colors of the toner having the sufficient remaining amounts, wherein the plurality of specific colors are implemented to be different according to ratios of the combined colors of the toner.

The method may further include allowing a user to select one of the plurality of corrected colors, wherein outputting the corrected color includes outputting the corrected color selected by the user.

Generating the corrected color includes determining whether each of the remaining amounts of the plurality of toner is less than or equal to a reference level and generating, if any of the remaining amounts of the plurality of toner is less than or equal to the reference level, a plurality of corrected colors similar to the original color by combining colors of toner having the remaining amounts that are higher than the reference level.

The foregoing and/or other aspects and utilities of the present general inventive concept may also be achieved by providing an image forming apparatus including a plurality of toner having different colors; a color analyzer to analyze an original color of print data; a controller to generate a corrected color similar to the original color according to respective remaining amounts of the plurality of toner; and an output unit to output the corrected color.

The image forming apparatus may further include a detector to detect the respective remaining amounts of the plurality of toner, wherein the controller compares each of the remaining amounts of the plurality of toner with a predetermined reference level and generates a plurality of corrected colors similar to the original color by combining colors of toner having the remaining amounts that are higher than the reference level if any of the remaining amounts of the plurality of toner is less than or equal to the reference level.

The controller is provided with a color correction table that stores a specific color implemented by combining colors of toner having the remaining amounts that are higher than the reference level.

The color correction table stores a plurality of specific colors implemented to be different according to ratios of the combined colors of the toner having the remaining amounts that are higher than the reference level to compensate for the color of the toner having the remaining amount less than or equal to the reference level.

The image forming apparatus may further include an operating panel to allow a user to select one of the plurality of corrected colors, wherein the controller outputs the corrected color selected by the user through the output unit.

The image forming apparatus may further include a report generator to generate a report including the plurality of corrected colors printed on the report, wherein the operating panel allows the user to select one of the plurality of corrected colors printed on the generated report.

The foregoing and/or other aspects and utilities of the present general inventive concept may be achieved by providing a color image forming apparatus, including a color analyzer to analyze low levels of toners among a plurality of color toners and a controller to generate substitutes of the low level toners by using combinations of the plurality of toners not having the low levels.

The controller may include a corrected sample image generator to generate a plurality of substitute sample images whose colors have been adjusted to simulate the low level toner.

The color image forming apparatus may further include a storage to store color correction tables which the sample image generator uses to generate a substitute sample image.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which:

FIG. 4 illustrates an example screen to select a corrected sample image.

DETAILED DESCRIPTION OF THE PREFERRED EMBODIMENTS

Figure 1:
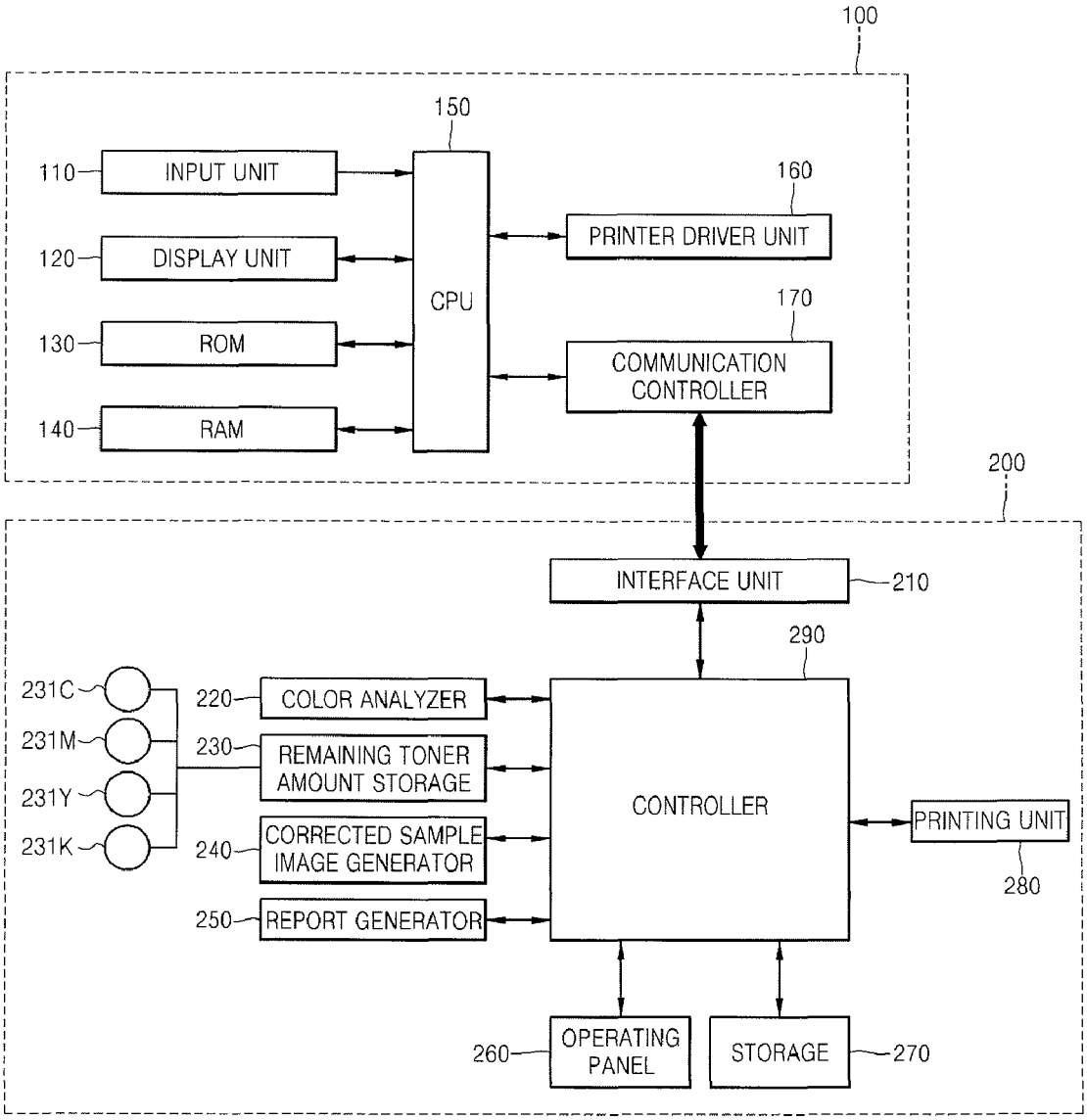
FIG. 1 is a schematic control block diagram of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below to explain the present general inventive concept by referring to the figures.

FIG. 1 is a schematic control block diagram of an image forming apparatus according to an embodiment of the present general inventive concept.

As illustrated in FIG. 1, the image forming apparatus according to the present embodiment includes a host computer 100 and an image forming apparatus 200.

The host computer 100 implements a printer driver to transfer a print command and print data to the image forming apparatus 200 to print an image and the image forming apparatus 200 prints the print data according to the print command received from the host computer 100.

First, the configuration of the host computer 100 is described as follows. The host computer 100 includes an input unit 110, a display unit 120, a Read Only Memory (ROM) 130, a Random Access memory (RAM) 140, a Central Processing Unit (CPU) 150, a printer driver unit 160, and a communication controller 170.

The input unit 110 is a user interface through which the user can set a variety of functions supported by the host computer 100. A keyboard, a mouse, or the like is used as the input unit 100. The user operates the keyboard, the mouse, or the like to input a variety of commands required for system operation to the host computer 100. These input commands are transferred to the CPU 150 through a system bus.

The display unit 120 is also a user interface. The user can confirm information of a variety of programs implemented at the host computer 100 through characters or graphics displayed on the display unit 120. A cathode Ray Tube (CRT), a Liquid Crystal Display (LCD), or the like is used as the display unit 120. The user can confirm implementing states, results, and the like of programs with reference to a user interface (UI) window displayed on the display unit 120.

The ROM 130 is nonvolatile memory that keeps content stored in it unchanged even when power of the host computer 100 is off. The ROM 130 stores a control program such as an operating system (OS) required to implement functions of the host computer 100 and a variety of application programs.

The RAM 140 is volatile memory that stores a variety of data generated while programs are running.

The CPU 150 reads the control program stored in the ROM 130 and controls operations of the host computer 100. The CPU 150 also performs a variety of functions through application programs that the user desires to implement and stores print data generated while application programs are running in the RAM 140. The CPU 150 controls the printer driver unit 160 to drive a printer driver to control operations of the image forming apparatus 200.

The printer driver unit 160 implements a printer driver to control print operations of the image forming apparatus 200.

The communication controller 170 transmits print data generated at the host computer 100 to the image forming apparatus 200.

The image forming apparatus is configured as follows. The image forming apparatus 200 includes an interface unit 210, a color analyzer 220, a remaining toner amount storage 230, a corrected sample image generator 240, a report generator 250, an operating panel 260, a storage 270, a printing unit 280, and a controller 290.

The interface unit 210 is provided to be connectable to the host computer 100 and supports a communication interface with the host computer 100. That is, the interface unit 210 transfers a print command and print data received from the host computer 100 to the controller 260 that will be described later.

The color analyzer 220 analyzes RGB information included in the print data to analyze an original color of the print data. For example, the color analyzer 220 performs rendering on the print data to obtain original color information of the print data.

The remaining toner amount storage 230 stores information of the currently remaining amount of toner 231C, 231M, 231Y, and 231K of each of the CMYK colors provided in the image forming apparatus 200. Using this information, the controller 290 determines whether the remaining amount of toner 231C, 231M, 231Y, and 231K of any of the CMYK colors is insufficient.

The corrected sample image generator 240 generates a plurality of corrected sample images whose colors have been corrected to be similar to the original color of the print data by combining toner colors other than the insufficient toner color according to a control signal from the controller 290.

The report generator 250 generates a report including the plurality of corrected sample images generated by the corrected sample image generator 240.

The operating panel 260 includes an operating unit and an LCD unit. The operating panel 260 transfers a command which the user has input through the operating unit to the controller 290 and displays states of the image forming apparatus 200 on the LCD unit according to a control signal from the controller 290.

The storage 270 stores a control program or the like to control the image forming apparatus 200. The storage 270 also stores a color correction table in which color combination ratios are recorded to allow unavailable colors to be expressed by combinations of available colors. The color combination ratios are used to obtain specific colors by combining other colors according to the color combination ratios. Preferably, the storage 270 stores a plurality of color correction tables in which different color combination ratios are recorded. In this case, to generate the plurality of corrected sample images, the corrected sample image generator 240 combines colors by sequentially using the color correction tables.

The printing unit 280 prints print data on a sheet of paper according to a control signal from the controller 290.

The controller 290 controls the printing unit 250 according to a print command received from the host computer 100 to control overall printing operations of the print data.

Each time print data is printed, the controller 290 indirectly estimates the remaining amount of toner of each color, taking into consideration the amount of toner of each color used when the print data is printed and stores the estimated remaining amount of toner of each color and associated information in the remaining toner amount storage 230. When a remaining toner amount detection sensor is provided in the image forming apparatus, the controller 290 can directly detect the remaining amount of toner of each color, instead of indirectly estimating the remaining amount of toner. In this case, the controller 290 detects the amount of toner provided in the image forming apparatus 200 at preset time intervals and stores the detected information in the remaining toner amount storage 230.

The controller 290 analyzes the original color of the print data through the color analyzer 220 and analyzes the remaining amount of toner 231C, 231M, 231Y, and 231K of each of the CMYK colors stored in the remaining toner amount storage 230.

Figure 2:
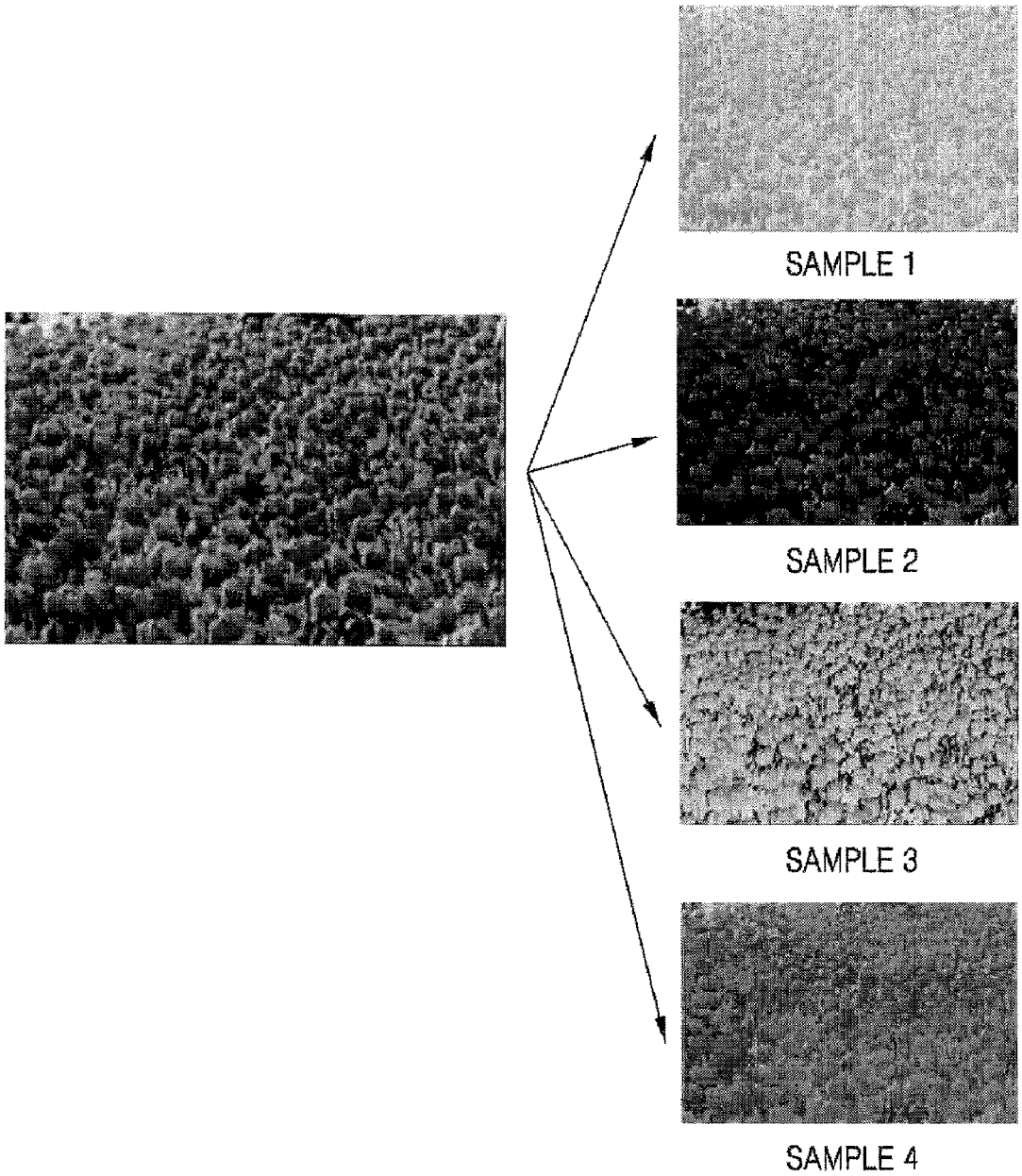
FIG. 2 illustrates an example comparison of a color of print data with colors of a plurality of corrected sample images generated by a corrected sample image generator illustrated in FIG. 1.

If it is determined from the analysis of the remaining amount of toner that the remaining amount of toner of any of the four colors is less than a reference level (i.e., the remaining amount of toner of any color is insufficient), the controller 290 generates, through the corrected sample image generator 240, a plurality of corrected (or substitute) sample images such as samples 1 to 4 illustrated in FIG. 2 whose colors have been corrected to be similar to the analyzed original color of the print data by combining colors of toner other than the color of the insufficient toner. Here, the controller 290 controls the corrected sample image generator 240 to correct the color of the insufficient toner using the other colors to generate a plurality of corrected sample images whose colors are similar to the original color of the print data. To accomplish this, one or more color correction tables, which express specific colors by combinations of other colors so that unavailable colors can be expressed using available colors, are stored in the storage 270. For example, when the toner color "Cyan" is unavailable, it can be expressed approximately by adjusting the amount of toner of the other colors "Magenta," "Yellow," and "Black," and when the toner color "Yellow" is unavailable, it can be expressed approximately by adjusting the amount of toner of the other colors "Cyan," "Magenta," and "Black." Also, when two or more toner colors are unavailable, they can be expressed approximately using the other colors with reference to the color correction tables.

Figure 3:
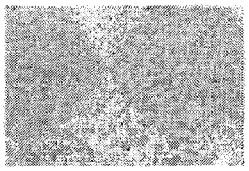
FIG. 3 illustrates an example report generated by a report generator illustrated in FIG. 1.
Figure 3:
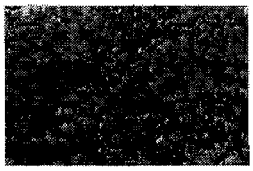
Figure 3:
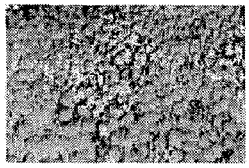
Figure 3:
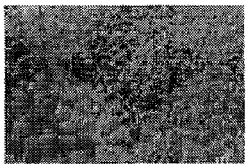

The controller 290 generates, through the report generator 250, a report as illustrated in FIG. 3 including the plurality of corrected sample images generated by the corrected sample image generator 240.

The controller 290 prints the report generated by the report generator 250 through the printing unit 280 so as to allow the user to view the printed report and to select a desired one of the plurality of corrected sample images.

After printing the report, the controller 290 displays a screen as illustrated in FIG. 4 to allow the user to select a desired one of the plurality of corrected sample images through the operating panel 260. The controller 290 then prints the corrected sample image selected by the user.

Figure 5:
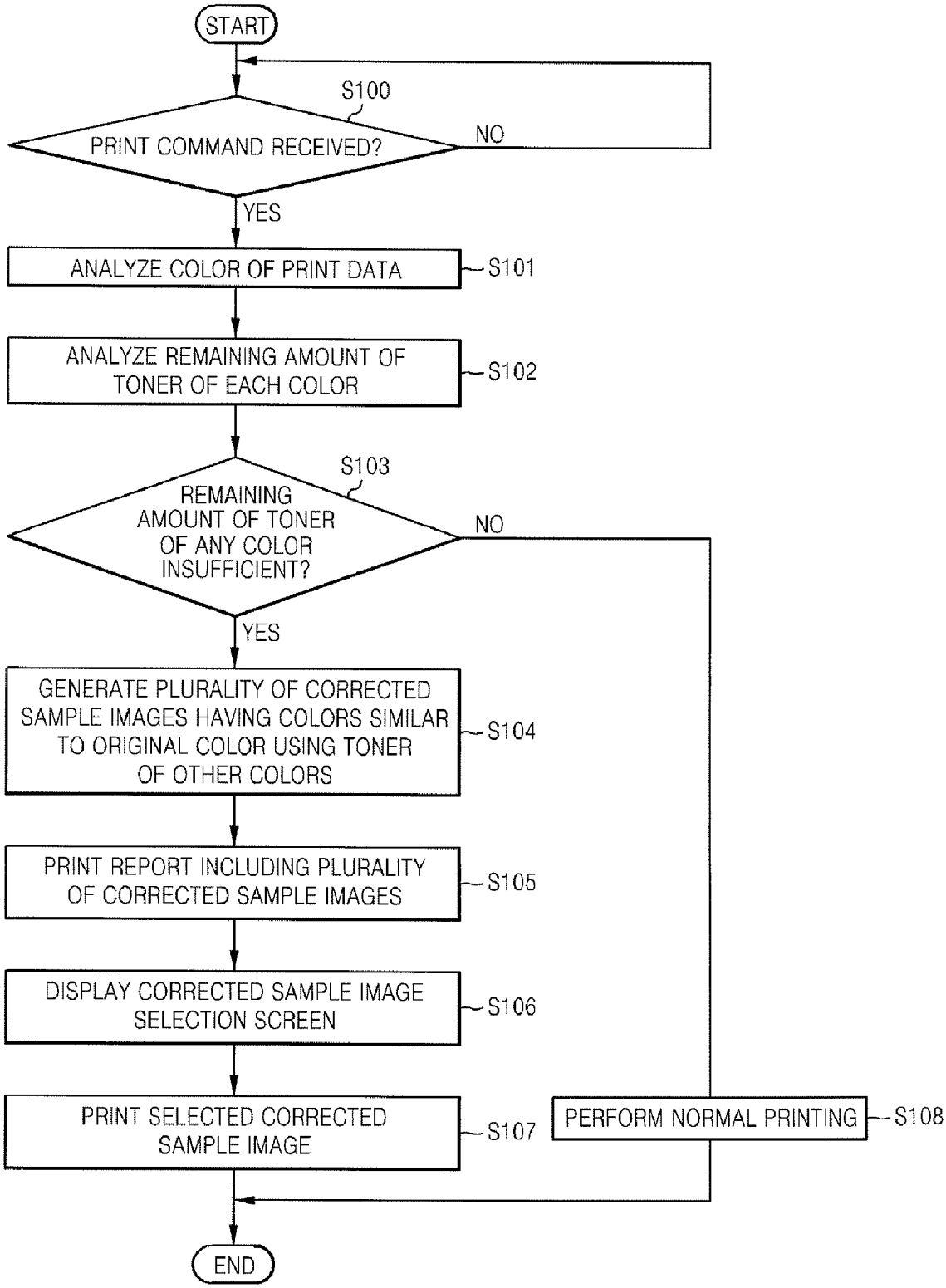
FIG. 5 is a flow chart illustrating a method of controlling an image forming apparatus according to an embodiment of the present general inventive concept.

Operations of the image forming apparatus configured as described above will now be described with reference to FIG. 5. First, the controller 290 determines in operation S100 whether it has received a print command. When a print command has been received, the controller 290 analyzes the color of print data to be printed through the color analyzer 220 in operation S101.

Then, in operation S102, the controller 290 analyzes the remaining amount of toner 231C, 231M, 231Y, and 231K of each of the CMYK colors based on information of the remaining amount of each of the CMYK colors stored in the remaining toner amount storage 230.

After analyzing the remaining amount of toner 231C, 231M, 231Y, and 231K of each of the CMYK colors, the controller 290 determines, in operation S103, whether the remaining amount of toner of any of the four colors is insufficient by checking from the analysis whether the remaining amount of toner of any color is less than a reference level. If the determination of operation S103 is that the remaining amounts of toner of all colors are sufficient, the controller 290 prints the print data normally in operation S108.

On the other hand, if the determination of operation S103 is that the remaining amount of toner of any color is insufficient, the controller 290 generates, through the corrected sample image generator 240, a plurality of corrected sample images having colors similar to the original color of the print data by combining toner colors other than the insufficient toner color based on the color correction tables stored in the storage 270 in operation S104.

After generating the plurality of corrected sample images through the report generator 250, the controller 290 generates, in operation S105, a report including the plurality of corrected sample images in thumbnail format and prints the generated report through the printing unit 280. This allows the user to compare the plurality of corrected sample images on the printed report and to determine one of the corrected sample images, which has a desired color.

After printing the report, the controller 290 displays, in operation S106, a screen to allow the user to select a desired one of the plurality of corrected sample images through the operating panel 260 and prints, in operation S107, the corrected sample image selected by the user.

As is apparent from the above description, the present general inventive concept provides an image forming apparatus and a method of controlling the image forming apparatus as follows. When print data is printed, the remaining amount of toner of each of the CMYK colors is analyzed. If the remaining amount of toner of any color is insufficient, a plurality of corrected sample images, whose colors have been corrected to be similar to the original color of the print data by combining colors of toner other than the insufficient remaining amount of toner, is printed in a report format. This allows the user to print their preferred colors even if the remaining amount of toner of any color is insufficient, thereby increasing convenience and economic efficiency.

Although a few embodiments of the present general inventive concept have been shown and described, it would be appreciated by those skilled in the art that changes may be made in these embodiments without departing from the principles and spirit of the general inventive concept, the scope of which is defined in the appended claims and their equivalents.

What is claimed is:

1. A method to control an image forming apparatus including a plurality of toners having different colors, the method comprising:

analyzing an original color of print data;

analyzing respective remaining amounts of the plurality of toners of the image forming apparatus;

if any of the remaining amounts of the plurality of toner is insufficient, generating at least one corrected color similar to the original color using the toners that are not insufficient;

generating a print report including the at least one corrected color;

selecting one of the at least one corrected color printed on the report; and printing the print data according to the selected color.

2. The method according to claim 1, wherein determining whether any of the remaining amounts of the plurality of toners is insufficient includes determining whether each of the remaining amounts of the plurality of toners is less than or equal to a predetermined reference level.

3. The method according to claim 1, wherein the plurality of corrected colors is implemented as a plurality of specific colors to compensate for the color of the toner having the insufficient remaining amount by combining the colors of the toners having the sufficient remaining amounts, wherein the plurality of specific colors are implemented to be different according to ratios of the combined colors of the toners.

4. The method according to claim 1, wherein the selecting one of the at least one corrected color includes allowing a user to select one of the at least one corrected color printed on the report.

5. The method according to claim 1, wherein the generating at least one corrected color includes determining whether each of the remaining amounts of the plurality of toners is less than or equal to a reference level and generating, if any of the remaining amounts of the plurality of toners is less than or equal to the reference level, at least one corrected color similar to the original color by combining colors of toner having the remaining amounts that are higher than the reference level.

6. An image forming apparatus comprising:

a plurality of toners having different colors;

a color analyzer to analyze an original color of print data;

a controller to generate at least one corrected color similar to the original color, if any remaining amounts of the plurality of toners is insufficient, using the toners that are not insufficient;

a report generator to generate a report including the at least one corrected color printed on the report;

an operating panel to allow a user to select one of the at least one corrected color; and an output unit to output the image corresponding to the print data in the selected one of the at least one corrected color.

7. The image forming apparatus according to claim 6, further comprising:

a detector to detect the respective remaining amounts of the plurality of toner, wherein the controller compares each of the remaining amounts of the plurality of toner with a predetermined reference level and generates the at least one corrected color similar to the original color by combining colors of toners having the remaining amounts that are higher than the reference level if any of the remaining amounts of the plurality of toners is less than or equal to the reference level.

8. The image forming apparatus according to claim 7, wherein the controller is provided with a color correction table that stores a specific color implemented by combining colors of toners having the remaining amounts that are higher than the reference level.

9. The image forming apparatus according to claim 8, wherein the color correction table stores a plurality of specific colors implemented to be different according to ratios of the combined colors of the toners having the remaining amounts that are higher than the reference level to compensate for the color of the toners having the remaining amount less than or equal to the reference level.

* * * * *